US007748566B1

(12) United States Patent
Mesa

(10) Patent No.: US 7,748,566 B1
(45) Date of Patent: Jul. 6, 2010

(54) BATHROOM DISPENSER AND ORGANIZER

(76) Inventor: Alberto Mesa, 10393 N. Kendall Dr. #U3, Miami, FL (US) 33176

( * ) Notice: Subject to any disclaimer, the term of this patent is extended or adjusted under 35 U.S.C. 154(b) by 0 days.

(21) Appl. No.: 10/306,432

(22) Filed: Nov. 27, 2002

(51) Int. Cl.
*B65D 35/28* (2006.01)

(52) U.S. Cl. ..... 222/102; 222/105; 222/94; 222/192; 132/314

(58) Field of Classification Search ..... 222/101–102, 222/105–106, 92–95, 98, 192, 132, 135; 132/315, 286, 314
See application file for complete search history.

(56) References Cited

U.S. PATENT DOCUMENTS 2,411,196 A * 11/1946 Dolan ..... 132/315
2,548,535 A * 4/1951 Iannone et al. ..... 222/93
2,667,287 A * 1/1954 Cook ..... 141/379
2,876,934 A * 3/1959 Brim ..... 222/102
3,204,823 A * 9/1965 Watson, Jr. ..... 222/93
3,241,721 A * 3/1966 Freeman ..... 222/93
4,213,542 A * 7/1980 Wilson ..... 222/102
5,178,302 A * 1/1993 Cheng ..... 222/102
5,230,444 A * 7/1993 Dunbar ..... 222/180
5,487,877 A * 1/1996 Choi ..... 422/300
5,662,130 A * 9/1997 Wiltshire ..... 132/323
5,678,733 A * 10/1997 Ong ..... 222/108
5,690,255 A * 11/1997 White ..... 222/135
D414,362 S * 9/1999 Olmos ..... D6/525
6,530,502 B2 * 3/2003 Neal ..... 222/192
6,719,169 B1 * 4/2004 Gandy ..... 222/1

* cited by examiner

*Primary Examiner*—Frederick Nicolas

(57) ABSTRACT

A bathroom dispenser and organizer is provided, comprising a freestanding rectangular storage unit with cavities for toothbrushes, a flat section for bar soap, a storage area with a lid and a pump-style spout for liquid soap, two slots configured to hold tubes, and a set of rollers within each slot, wherein tube contents are dispensed by inserting the tube into a slot between the rollers and turning the rollers. The bathroom dispenser and organizer has particular utility in connection with dispensing toothpaste, shaving cream, and liquid soap, and neatly storing bathroom items such as toothbrushes, razors, and bar soap.

13 Claims, 2 Drawing Sheets

BATHROOM DISPENSER AND ORGANIZER

BACKGROUND OF THE INVENTION

1. Field of the Invention

The present invention relates to a bathroom dispenser and organizer for use in connection with keeping a bathroom area neat. The bathroom dispenser and organizer has particular utility in connection with dispensing toothpaste, shaving cream, and liquid soap, and neatly storing bathroom items such as toothbrushes, razors, and bar soap.

2. Description of the Prior Art

A bathroom dispenser and organizer is desirable for dispensing toothpaste, shaving cream, and liquid soap, and neatly storing bathroom items such as toothbrushes, razors, and bar soap.

The use of holders and dispensers is known in the prior art. For example, U.S. Pat. No. 6,168,023 to Cooper discloses a caddy shaver receptacle for shaving items and instruments. However, the Cooper '023 patent does not provide for dispensing toothpaste, and does not provide for the storage of soap and toothbrushes.

U.S. Pat. No. 5,566,842 to Dennis discloses a holder for storing a toothpaste dispenser and toothbrushes. However, the Dennis '842 patent does not provide for dispensing shaving cream, and additionally does not provide for the storage of soap.

U.S. Pat. No. Des. 363,847 to Young discloses an automatic toothpaste tube dispenser. However, the Young '847 patent does not provide for dispensing shaving cream, and cannot provide for the organized storage of bathroom items such as soap and toothbrushes.

U.S. Pat. No. 4,274,556 to Thiessen discloses a dual dispensing container. However, the Thiessen '556 patent does not provide for the organized storage of bathroom items such as soap and toothbrushes.

U.S. Pat. No. 5,199,610 to Gagliardi discloses a motorized toothpaste dispenser. However, the Gagliardi '610 patent does not provide for dispensing shaving cream, and cannot provide for the storage of soap.

Lastly, U.S. Pat. No. 5,277,332 to Rogers discloses a multiple dispensing container for viscous materials, cups, and toothpaste. However, the Rogers '332 patent does not provide for dispensing shaving cream, and has the additional deficiency of not providing for the organized storage of soap and toothbrushes.

While the above-described devices fulfill their respective, particular objectives and requirements, the aforementioned patents do not describe a bathroom dispenser and organizer that allows for dispensing toothpaste, shaving cream, and liquid soap, and neatly storing bathroom items such as toothbrushes, razors, and bar soap. The prior art patents make no provision for dispensing and storing all of these types of items.

Therefore, a need exists for a new and improved bathroom dispenser and organizer that can be used for dispensing toothpaste, shaving cream, and liquid soap, and neatly storing bathroom items such as toothbrushes, razors, and bar soap. In this regard, the present invention substantially fulfills this need. In this respect, the bathroom dispenser and organizer according to the present invention substantially departs from the conventional concepts and designs of the prior art, and in doing so provides an apparatus primarily developed for the purpose of dispensing toothpaste, shaving cream, and liquid soap, and neatly storing bathroom items such as toothbrushes, razors, and bar soap.

SUMMARY OF THE INVENTION

In view of the foregoing disadvantages inherent in the known types of holders and dispensers now present in the prior art, the present invention provides an improved bathroom dispenser and organizer, and overcomes the above-mentioned disadvantages and drawbacks of the prior art. As such, the general purpose of the present invention, which will be described subsequently in greater detail, is to provide a new and improved bathroom dispenser and organizer which has all the advantages of the prior art mentioned heretofore and many novel features that result in a bathroom dispenser and organizer which is not anticipated, rendered obvious, suggested, or even implied by the prior art, either alone or in any combination thereof.

To attain this, the present invention essentially comprises a bathroom dispenser and organizer, comprising a storage unit, a plurality of cavities in the storage unit, a flat section connected to the storage unit, a storage area in the storage unit, at least one slot in the storage unit configured to hold a tube, and a set of rollers within each slot.

In one embodiment, the present invention comprises a bathroom dispenser and organizer, comprising a storage unit, a plurality of cavities in the storage unit, a flat section connected to the storage unit, a storage area in the storage unit, a lid connected to the top of the storage area, a pump-style spout extending through the lid, at least one slot in the storage unit configured to hold a tube, and a set of rollers within each slot.

In another embodiment, the present invention comprises a bathroom dispenser and organizer for oral care products, shaving cream, and soap, comprising a freestanding rectangular storage unit, a plurality of cavities in the storage unit configured to hold toothbrush handles, a flat section connected to the storage unit, a storage area in the storage unit, a lid connected to the top of the storage area, a pump-style spout extending through the lid, two slots in the storage unit, each configured to hold a tube, and a set of rollers within each slot, wherein the contents of a tube are dispensed by inserting the tube into a slot between the rollers and turning the rollers.

There has thus been outlined, rather broadly, the more important features of the invention in order that the detailed description thereof that follows may be better understood and in order that the present contribution to the art may be better appreciated.

The invention may also include a master cylinder, a compression cylinder, a push button, and a ratcheting mechanism. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bathroom dispenser and organizer that has all of the advantages of the prior art holders and dispensers and none of the disadvantages.

It is another object of the present invention to provide a new and improved bathroom dispenser and organizer that may be easily and efficiently manufactured and marketed.

An even further object of the present invention is to provide a new and improved bathroom dispenser and organizer that has a low cost of manufacture with regard to both materials and labor, and which accordingly is then susceptible of low prices of sale to the consuming public, thereby making such bathroom dispenser and organizer economically available to the buying public.

Still another object of the present invention is to provide a new bathroom dispenser and organizer that provides in the apparatuses and methods of the prior art some of the advantages thereof, while simultaneously overcoming some of the disadvantages normally associated therewith.

Even still another object of the present invention is to provide a bathroom dispenser and organizer for dispensing toothpaste, shaving cream, and liquid soap. This allows an individual to conveniently and neatly dispense bathroom care products.

Still yet another object of the present invention is to provide a bathroom dispenser and organizer for neatly storing bathroom items such as toothbrushes, razors, and bar soap. This makes it possible to keep the bathroom area neat and organized.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
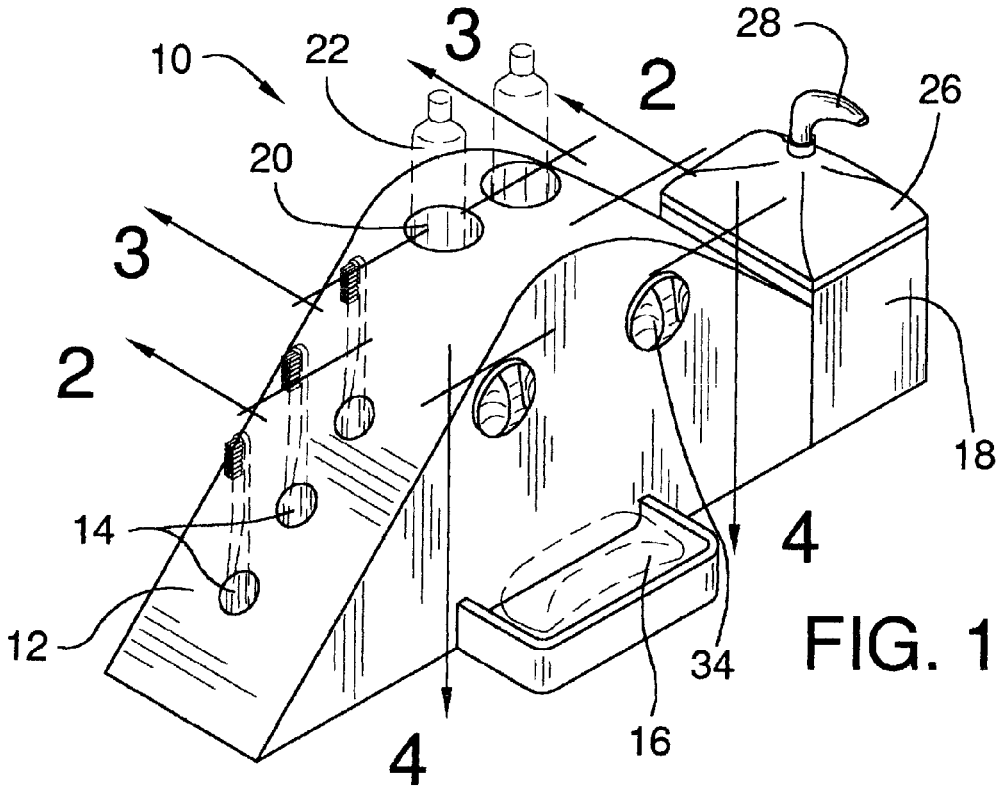
FIG. 1 is an isometric perspective view of the preferred embodiment of the bathroom dispenser and organizer constructed in accordance with the principles of the present invention.

Referring now to the drawings, and particularly to FIGS. 1-4, a preferred embodiment of the bathroom dispenser and organizer of the present invention is shown and generally designated by the reference numeral 10.

In FIG. 1, a new and improved bathroom dispenser and organizer 10 of the present invention for dispensing toothpaste, shaving cream, and liquid soap, and neatly storing bathroom items such as toothbrushes, razors, and bar soap is illustrated and will be described. More particularly, the bathroom dispenser and organizer 10 comprises a storage unit 12 which preferably is freestanding and which may be rectangular or any other suitable shape. Cavities 14 in the storage unit 12 are configured to hold toothbrush handles. A flat section 16 connected to the storage unit 12 is configured to hold a bar of soap. A storage area 18 is suitable for holding liquid soap, with a lid 26 covering the storage area 18, and a pump-style spout 28 to dispense the liquid soap. Other liquids such as hand cream may also be stored and dispensed in the same way. Two slots 20 in the storage unit 12 are each configured to hold a tube 22 that is inserted into a slot 20 and between a set of rollers. Push button 34 action initiates action of the rollers to dispense the contents of the tube.

Figure 2:
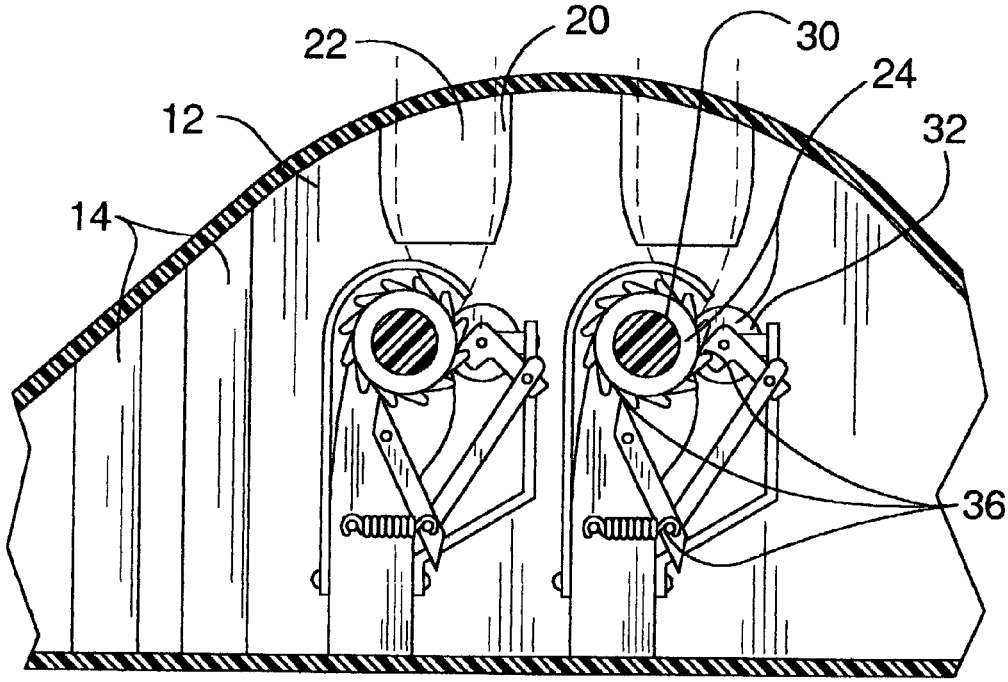
FIG. 2 is a front elevational cross-sectional view of the bathroom dispenser and organizer of the present invention illustrated in FIG. 1 and taken along the line 2-2.

FIG. 2 is a front elevational cross-sectional view of the bathroom dispenser and organizer of the present invention, and illustrates the storage unit 12, cavities 14, slots 20, and tubes 22. Cross-sectional detail illustrates the master cylinder 30 contacting the compression cylinder 32, with a spring-loaded ratcheting mechanism 36 provided to turn the rollers 24 to dispense the contents of the tube 22.

Figure 3:
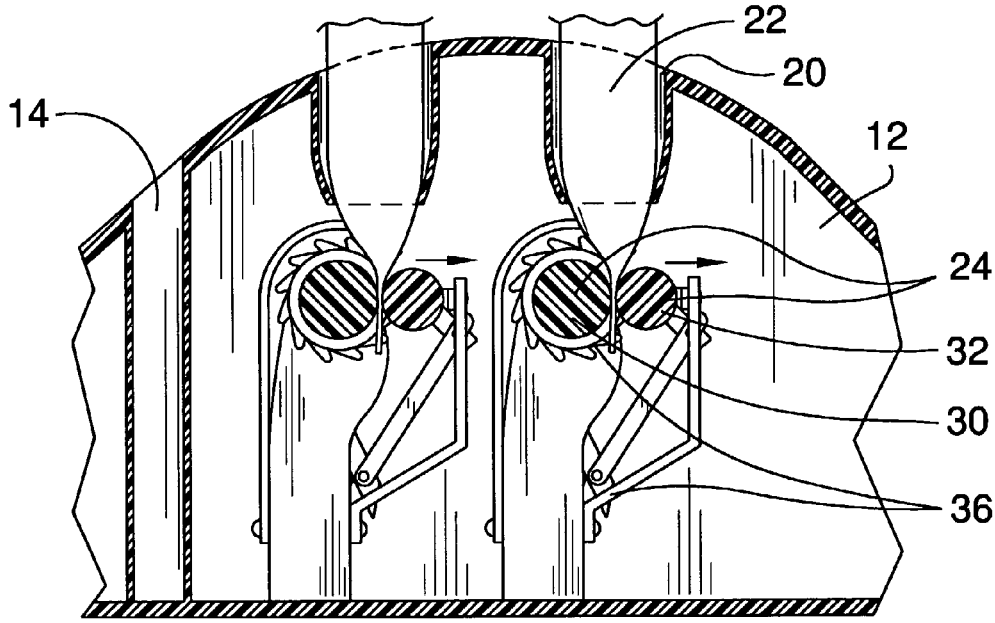
FIG. 3 is a front elevational cross-sectional view of the bathroom dispenser and organizer of the present invention illustrated in FIG. 1 and taken along the line 3-3.

FIG. 3 is also a front elevational cross-sectional view of the bathroom dispenser and organizer of the present invention, and illustrates the storage unit 12, cavities 14, slots 20, and tubes 22, with cross-sectional detail illustrating the master cylinder 30 contacting the compression cylinder 32, with a ratcheting mechanism 36 provided to turn the rollers 24 to dispense the contents of the tube 22.

Figure 4:
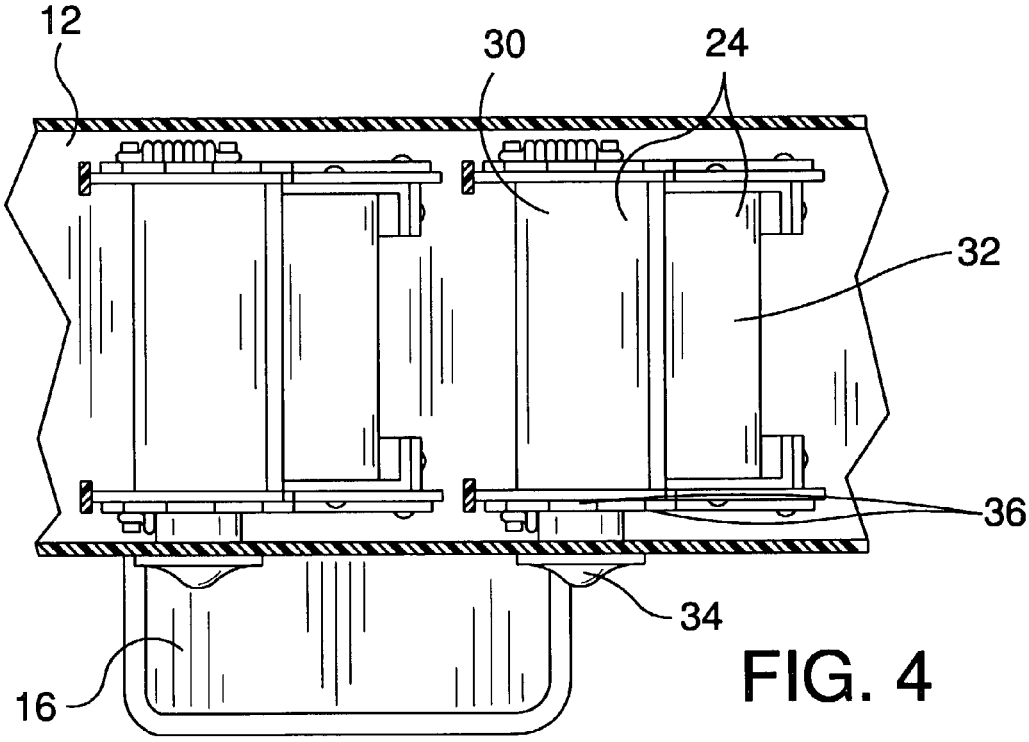
FIG. 4 is a cross-sectional plan view of the bathroom dispenser and organizer of the present invention illustrated in FIG. 1 and taken along the line 4-4.

FIG. 4 is a cross-sectional plan view of the bathroom dispenser and organizer of the present invention and illustrates the storage unit 12, flat section 16, and rollers 24. The master cylinder 30 contacts the compression cylinder 32, with a ratcheting mechanism 36 provided by push button 34 action to turn the rollers 24.

In one embodiment, the bathroom dispenser and organizer of the present invention is a freestanding bathroom storage unit designed to house oral care products, shaving cream, and soap in one convenient location to eliminate time-consuming and frustrating searches for various items. In addition, this product aids in keeping the bathroom neat and organized. While designed primarily for use within homes, the bathroom dispenser and organizer of the present invention also has utility within hotels, motels, hospitals, and nursing homes.

In one embodiment, the bathroom dispenser and organizer of the present invention comprises a rectangular plastic, ceramic, wood, or glass storage unit which may be produced in various sizes to house different quantities of bathroom necessities. This product incorporates a quantity of cavities into which the handles of toothbrushes are inserted for storage. In addition, a bar of soap may be placed atop a flat section of the storage unit. The bathroom dispenser and organizer also contains a storage area for liquid soap which may feature a pump-style spout through which the soap is dispensed.

The bathroom dispenser and organizer of the present invention features a slot in which the tube of toothpaste is inserted. This slot contains a set of rollers designed to easily dispense the toothpaste while allowing the entire contents of the tube to be used. The rollers may allow the maximum amount of toothpaste to be dispensed from the tube with the minimal amount of effort being expended. The end of the tube is inserted within the rollers. When desiring to brush one's teeth, the cap is removed from the tube. The rollers are turned, causing a quantity of the toothpaste to be dispensed. A similar mechanism is available to dispense shaving cream or gel. It is possible to produce the bathroom dispenser and organizer of the present invention in a wide array of colors to coordinate with various bathroom decors.

The bathroom dispenser and organizer of the present invention fulfills the need for a storage unit that keeps oral care and other bathroom products organized and readily available. The appealing features of the bathroom dispenser and organizer of the present invention include its convenience, practicality, and reasonable price. The bathroom dispenser and organizer provides a convenient storage area for various bathroom necessities so that they are safely housed in a convenient unit instead of being strewn throughout the bathroom, thus providing the bathroom with a neat and attractive appearance. Furthermore, the use of this storage unit saves members of the household the time, energy, and aggravation associated with searching through drawers, cabinets, and other locations for toothpaste, a toothbrush, shaving cream, and other similar items.

The bathroom dispenser and organizer of the present invention also incorporates a set of rollers which control the squeezing of a tube of toothpaste. This reduces the strain and frustration experienced by individuals. The inclusion of the rollers ensures that most of the toothpaste is removed from the tube for use, thus this product is economical. The use of the bathroom dispenser and organizer of the present invention may also reduce the mess associated with the standard methods of expelling a quantity of toothpaste. It also eliminates quarrels resulting from members of the household having different techniques for squeezing tubes of toothpaste.

In one embodiment, the bathroom dispenser and organizer of the present invention comprises a unitary base for receiving not only toothpaste, but also shaving cream containers within a recess associated with the top portion thereof for automatically dispensing each element from its respective container, and also provides for receiving and storing toothbrushes, liquid soap dispensers and bar soap.

In use, it can now be understood that the bathroom dispenser and organizer of the present invention has utility in connection with keeping a bathroom area neat. The bathroom dispenser and organizer has particular utility in connection with dispensing toothpaste, shaving cream, and liquid soap, and neatly storing bathroom items such as toothbrushes, razors, and bar soap.

While a preferred embodiment of the bathroom dispenser and organizer has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as metal or composite material may be used instead of the plastic, ceramic, wood, or glass storage unit described. Also, the unit may comprise any suitable shape instead of the rectangular shape described. And although dispensing toothpaste, shaving cream, and liquid soap, and neatly storing bathroom items such as toothbrushes, razors, and bar soap has been described, it should be appreciated that the bathroom dispenser and organizer herein described is also suitable for use in the kitchen or shower area, and can be used to store many different items such as a drinking glass, hair care items, and cosmetics. Furthermore, a wide variety of dispensers may be used instead of the rollers described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bathroom dispenser and organizer, comprising:
- a storage unit;
- a plurality of cavities in the storage unit;
- a flat section connected to the storage unit;
- a storage area in the storage unit; and
- a lid connected to the top of the storage area, and a pump-style spout extending through the lid;
- wherein said storage unit defines at least one slot therein configured to hold a tube; and
- a set of rollers within each slot.

2. A bathroom dispenser and organizer, comprising:
- a storage unit;
- a plurality of cavities in the storage unit;
- a flat section connected to the storage unit;
- a storage area in the storage unit;
- a lid connected to the top of the storage area;
- a pump-style spout extending through the lid;
- at least one slot in the storage unit configured to hold a tube; and
- a set of rollers within each slot.

3. The bathroom dispenser and organizer of claim 2, wherein the contents of a tube are dispensed by inserting the tube into a slot between the rollers and turning the rollers.

4. The bathroom dispenser and organizer of claim 2, further comprising a master cylinder, a compression cylinder, a push button, and a ratcheting mechanism, wherein pushing the push button engages the ratcheting mechanism, and turns the master cylinder against the compression cylinder, squeezing a tube between the rollers to dispense the contents of the tube.

5. The bathroom dispenser and organizer of claim 2, wherein the storage unit comprises a rectangular shape.

6. The bathroom dispenser and organizer of claim 2, further comprising a tube of toothpaste inserted into the slot.

7. The bathroom dispenser and organizer of claim 2, further comprising a tube of shaving cream inserted into the slot.

8. A bathroom dispenser and organizer for oral care products, shaving cream, and soap, comprising:
- a freestanding rectangular storage unit;
- a plurality of cavities in the storage unit configured to hold toothbrush handles;
- a flat section connected to the storage unit;
- a storage area in the storage unit;
- a lid connected to the top of the storage area;
- a pump-style spout extending through the lid;
- two slots in the storage unit, each configured to hold a tube; and
- a set of rollers within each slot;
- wherein the contents of a tube are dispensed by inserting the tube into a slot between the rollers and turning the rollers.

9. The bathroom dispenser and organizer of claim 8, further comprising a master cylinder, a compression cylinder, a push button, and a ratcheting mechanism, wherein pushing the push button engages the ratcheting mechanism, and turns the master cylinder against the compression cylinder, squeezing a tube between the rollers to dispense the contents of the tube.

10. The bathroom dispenser and organizer of claim 8, further comprising a tube of toothpaste and a tube of shaving cream inserted into the slots.

11. The bathroom dispenser and organizer of claim 8, wherein the pump-style spout dispenses liquid soap from the storage area.

12. The bathroom dispenser and organizer of claim 8, wherein the flat section is configured to hold a bar of soap.

13. The bathroom dispenser and organizer of claim 8, comprising at least one of plastic, ceramic, wood, or glass.

* * * * *